US008522664B2

(12) United States Patent
Chen et al.

(10) Patent No.: US 8,522,664 B2
(45) Date of Patent: Sep. 3, 2013

(54) HYDRAULIC ENERGY REDIRECTION AND RELEASE SYSTEM

(76) Inventors: Yun Chen, Clarksburg, MD (US); Wei Huang, Clarksburg, MD (US); Haoxing Chen, Clarksburg, MD (US)

( * ) Notice: Subject to any disclaimer, the term of this patent is extended or adjusted under 35 U.S.C. 154(b) by 144 days.

(21) Appl. No.: 13/285,049

(22) Filed: Oct. 31, 2011

(65) Prior Publication Data

US 2012/0144988 A1 Jun. 14, 2012

Related U.S. Application Data

(60) Provisional application No. 61/422,111, filed on Dec. 10, 2010.

(51) Int. Cl.
*F41H 5/02* (2006.01)
*F41H 7/00* (2006.01)
*F41H 1/00* (2006.01)

(52) U.S. Cl.
USPC ..... 89/36.02; 89/36.05; 2/2.5

(58) Field of Classification Search
USPC ..... 89/36.01, 36.02, 36.05; 428/911; 109/49.5; 2/2.5
See application file for complete search history.

(56) References Cited

U.S. PATENT DOCUMENTS

| | | | | |
|---|---|---|---|---|
| 2,748,391 | A * | 6/1956 | Lewis, Jr. et al. | 2/2.5 |
| 4,061,815 | A | 12/1977 | Poole, Jr. | |
| 6,012,162 | A | 1/2000 | Bullat | |
| 6,503,584 | B1 * | 1/2003 | McAlister | 428/34.1 |
| 7,794,808 | B2 | 9/2010 | Dudt et al. | |
| 2002/0054995 | A1 * | 5/2002 | Mazurkiewicz | 428/364 |
| 2006/0065111 | A1 * | 3/2006 | Henry | 89/36.02 |
| 2009/0094719 | A1 * | 4/2009 | Lim | 2/2.5 |
| 2010/0251451 | A1 | 10/2010 | Feldman et al. | |
| 2011/0107904 | A1 | 5/2011 | Queheillalt et al. | |
| 2011/0239346 | A1 * | 10/2011 | Doherty et al. | 2/2.5 |

OTHER PUBLICATIONS

Non-impact, blast-induced mild TBI and PTSD: Concepts and caveats; Brain Injury, Jul. 2011; 25(7-8): 641-650.
International Search Report issued in corresponding PCT Application No. PCT/US12/50810 on Jun. 10, 2013.

* cited by examiner

*Primary Examiner* — Michael David
(74) *Attorney, Agent, or Firm* — LeonardPatel PC; Michael A. Leonard, II; Sheetal S. Patel

(57) ABSTRACT

An apparatus for providing protection from blast and ballistic energy is provided. The apparatus includes a liquid storage mechanism containing a liquid and a rigid layer internal to the liquid storage mechanism. The apparatus also includes a pressure release mechanism configured to allow the liquid to exit the liquid storage mechanism when a pressure sufficient to open or activate the pressure release mechanism contacts the liquid storage mechanism and presses the liquid storage mechanism against the rigid layer.

8 Claims, 9 Drawing Sheets

HYDRAULIC ENERGY REDIRECTION AND RELEASE SYSTEM

CROSS REFERENCE TO RELATED APPLICATIONS

This application claims priority of U.S. Provisional Patent Application Ser. No. 61/422,111, filed Dec. 10, 2010. The subject matter of this earlier-filed application is hereby incorporated by reference in its entirety.

BACKGROUND

1. Field

The present invention generally relates to blast and ballistic protection. More specifically, the present invention pertains to blast and ballistic protection for the human body and for military systems.

2. Description of the Related Art

For military personnel and vehicles, it is of paramount importance to mitigate damage from blast waves and projectiles. The rapid impact (compression) effects of a blast overpressure wave on the human body are a reason why currently fielded ballistic body armor may successfully prevent penetrating and blunt impact injuries. However, present systems generally fail to mitigate damage from primary blast injuries caused by a blast overpressure wave. When a blast overpressure wave acts on body armor, the wave causes the body armor to move swiftly toward, and impact, the human body. Some of the kinetic energy is transferred to the body, causing high velocity behind armor blunt trauma (BABT). In this situation, the body armor may not be able to protect the body against the impact of the blast overpressure wave. Further, the body armor can potentially act in concert with the blast overpressure wave to increase the compression force exerted on the body, causing more serious blast-induced internal injuries. As such, an innovative personal body armor system that can effectively block propagation and interaction of blast overpressure in the human body may be desirable to prevent and mitigate the primary blast injuries.

SUMMARY

Certain embodiments of the present invention may provide solutions to the problems and needs in the art that have not yet been fully solved by conventional armor systems. For example, certain embodiments of the present invention use liquid to redirect energy from a blast or ballistic wave away from the protected individual or military system.

In one embodiment of the present invention, an apparatus includes a liquid storage mechanism containing a liquid and an insulating layer internal to the liquid storage mechanism. The insulating layer is positioned between an internal rigid layer and an external rigid layer. The apparatus also includes a pressure release mechanism configured to transfer kinetic energy to the liquid. When the liquid storage mechanism is impacted by a blast or ballistic pressure wave, the liquid storage mechanism is configured to press against the external rigid layer, insulating layer and internal rigid layer. The liquid storage mechanism is further configured to release the liquid via the pressure release mechanism when a sufficiently powerful blast or ballistic pressure wave opens or otherwise activates the pressure release mechanism.

In another embodiment of the present invention, an apparatus includes a liquid storage mechanism containing a liquid, an outer rigid layer external to the liquid storage mechanism, and an inner rigid layer internal to the liquid storage mechanism. The apparatus also includes a pressure release mechanism configured to allow the liquid to exit the liquid storage mechanism when a pressure sufficient to open or activate the pressure release mechanism impacts the outer rigid layer and is transferred to the liquid storage mechanism.

In yet another embodiment of the present invention, an apparatus includes a liquid storage mechanism containing a liquid and a rigid layer internal to the liquid storage mechanism. The apparatus also includes a pressure release mechanism configured to allow the liquid to exit the liquid storage mechanism when a pressure sufficient to open or activate the pressure release mechanism contacts the liquid storage mechanism and presses the liquid storage mechanism against the rigid layer.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
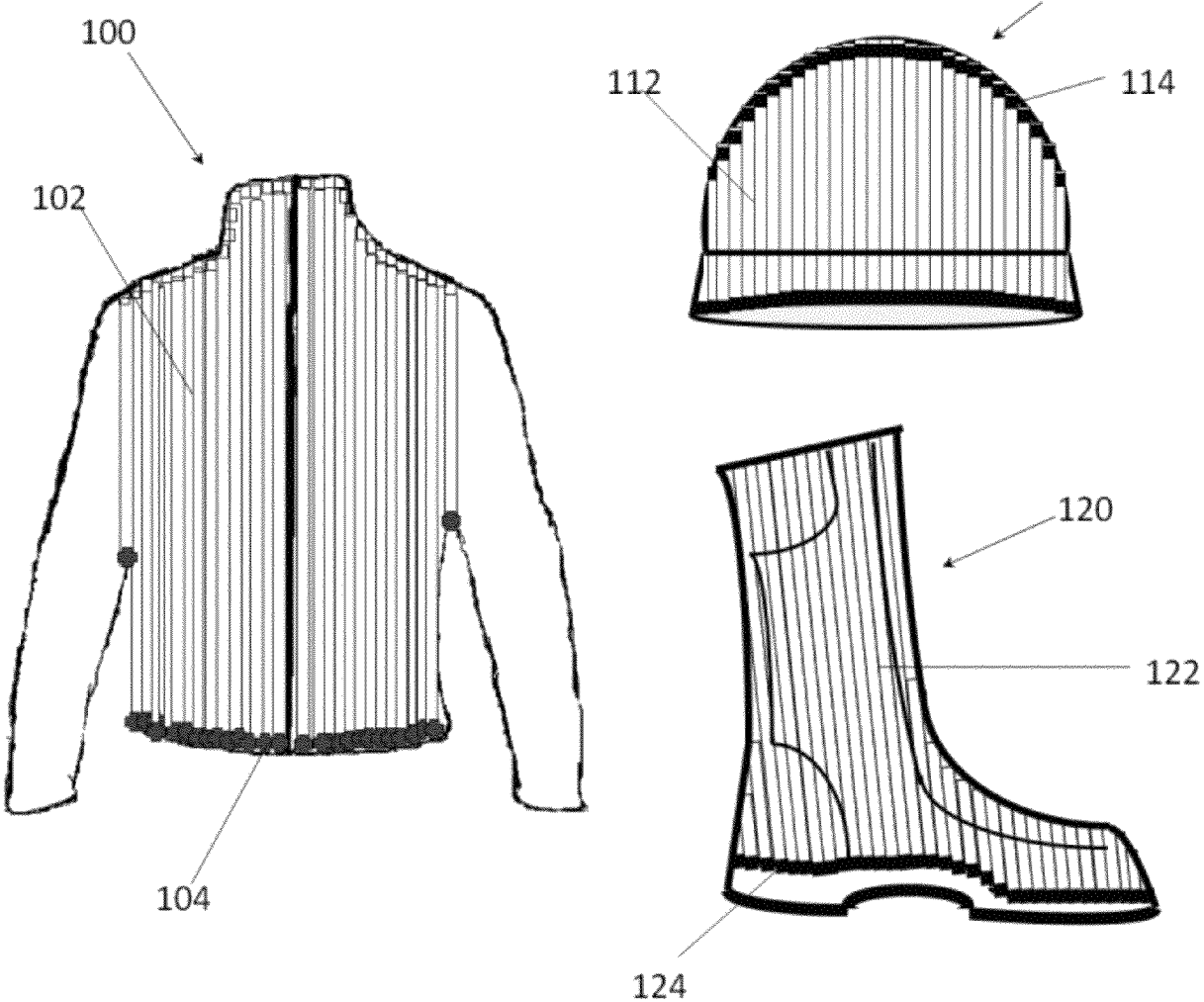
FIG. 1 illustrates a perspective view of body armor, a helmet, and a combat boot, according to an embodiment of the present invention.

It will be readily understood that the components of various embodiments of the present invention, as generally described and illustrated in the figures herein, may be arranged and designed in a wide variety of different configurations. Thus, the following more detailed description of the embodiments of the systems, apparatuses and methods of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

Some embodiments of the present invention pertain to a hydraulic energy redirection and release system for blast and ballistic protection. Embodiments may be used to develop advanced body armor, helmets, combat boots, and other gear that greatly reduce the threat of serious blast and ballistic injuries. For personal armor, some embodiments of the present invention include an outer layer of heat-resistant clothing material, a layer of liquid-filled tubes that are inserted into semi-circular troughs or grooves in a lightweight metal alloy plate (the outer alloy plate), a layer of packing foam, a lightweight metal alloy plate (the inner alloy plate), springs that pass through the packing foam layer and are mounted between the outer and inner alloy plates, a Kevlar® panel, and an inner layer of common clothing material. However, in some embodiments, projectile-resistant woven material other than Kevlar®, or any other projectile-resistant material or substance may be used.

The U-shaped liquid-filled tubes that are installed vertically in the semi-circular troughs or grooves of the outer alloy plate in some embodiments are employed as a blast or ballistic pressure transformer that redirect and release blast or ballistic kinetic energy from the outer surface of the protected objects, thus effectively attenuating blast or ballistic overpressures acting on the objects. The liquid tubes may be made of softer materials, such as rubber, plastic (e.g., polyurethane, a polymer, polyvinyl chloride lining, etc.), canvas, etc. The liquid may be an aqueous solution such as water or alcohol. The outer and inner metal alloy plates are made of a strong but lightweight metal or alloy material, such as a titanium alloy or an aluminum alloy. Both the springs and the packing foam layer can help reduce pressure on the inner alloy plate, thus attenuating behind armor blunt trauma (BABT) resulting from the rapid deformation of armor covering the body. The Kevlar® panel may be a bullet resistant panel that is currently used for personal armor such as ballistic vests, combat helmets, and ballistic face masks. The outer layer of heat resistant clothing material may be made from a fire-retardant material in some embodiments. The fire-retardant material may be Twaron®, TARAMID®, Nomex®, Arselon®, coated nylon, or any other suitable fire-retardant material.

Liquid is essentially incompressible and does not absorb blast energy to an appreciable extent. At the same time, liquid is an important transmission medium that is capable of moving high pressure loads and transferring kinetic energy to other objects due to its incompressibility. When a blast overpressure wave acts on a liquid, kinetic energy can not only be transformed into liquid pressure to cause a rapid physical movement, or displacement, of the liquid, but the kinetic energy can also be quickly released if the liquid is able to flow. Hence, blast overpressure wave mitigation by hydraulic energy redirection and release at an outer surface of personal body armor is an innovative approach to protect against life-threatening internal injuries caused by a blast overpressure wave.

Embodiments of the present invention may also be used for blast and ballistic protection of military systems including, but not limited to, armored vehicles, tanks, fighter aircraft, unmanned aerial vehicles (UAVs), bomber aircraft, transport aircraft, ships, and submarines. For military systems, some embodiments of the present invention include an outer metal plate, a layer of pipes filled with liquid, and an inner metal plate.

The advantages of some embodiments of the present invention include, without limitation, highly effective blast or ballistic wave migration, ballistic protection, heat resistance, low weight, good overall design and durability, armor that is easy to wear and carry, and low hindrance to the mobility and movement of the human body (such as walking, running, jumping, climbing, crawling, sitting, lying, falling to the prone position, etc.). Some embodiments of the present invention are able to effectively mitigate against the effects of blast or ballistic pressure waves on the protected objects or body by using a hydraulic energy redirection and release system and can successfully prevent penetrating and blunt impact injuries caused by ballistic projectiles such as bullets, bomb fragments and other objects propelled by explosions or fired from weapons. Further, the blast and ballistic protection system can reduce BABT without compromising penetration protection or increasing the areal density, as opposed to currently fielded ballistic armor designs. Further, the innovative overall design of some embodiments allows the system to have a relatively low weight, to be easily worn and carried, and to be used for extreme temperature environments (e.g., −20° C. to 60° C.). Further, the system does not significantly influence the mobility and movement of the human body, and allows war fighters and systems to maintain mission capability.

FIG. 1 illustrates a perspective view of body armor 100, a helmet 110, and a combat boot 120, according to an embodiment of the present invention. Body armor 100, helmet 110, and combat boot 120 have a series of liquid-filled tubes 102, 112, and 122, respectively. In this embodiment, liquid-filled tubes 102, 112, and 122 are installed vertically, but the direction and arrangement of the tubes is a matter of design choice and may differ in other embodiments. Openings 104, 114, and 124 are located at the lower or upper ends of liquid-filled tubes 102, 112, and 122, respectively. Openings 104, 114, and 124 permit the flow of liquid in liquid-filled tubes 102, 112, and 122, respectively, when a force acts on the liquid, such as blast pressure from an explosion.

Figure 2:
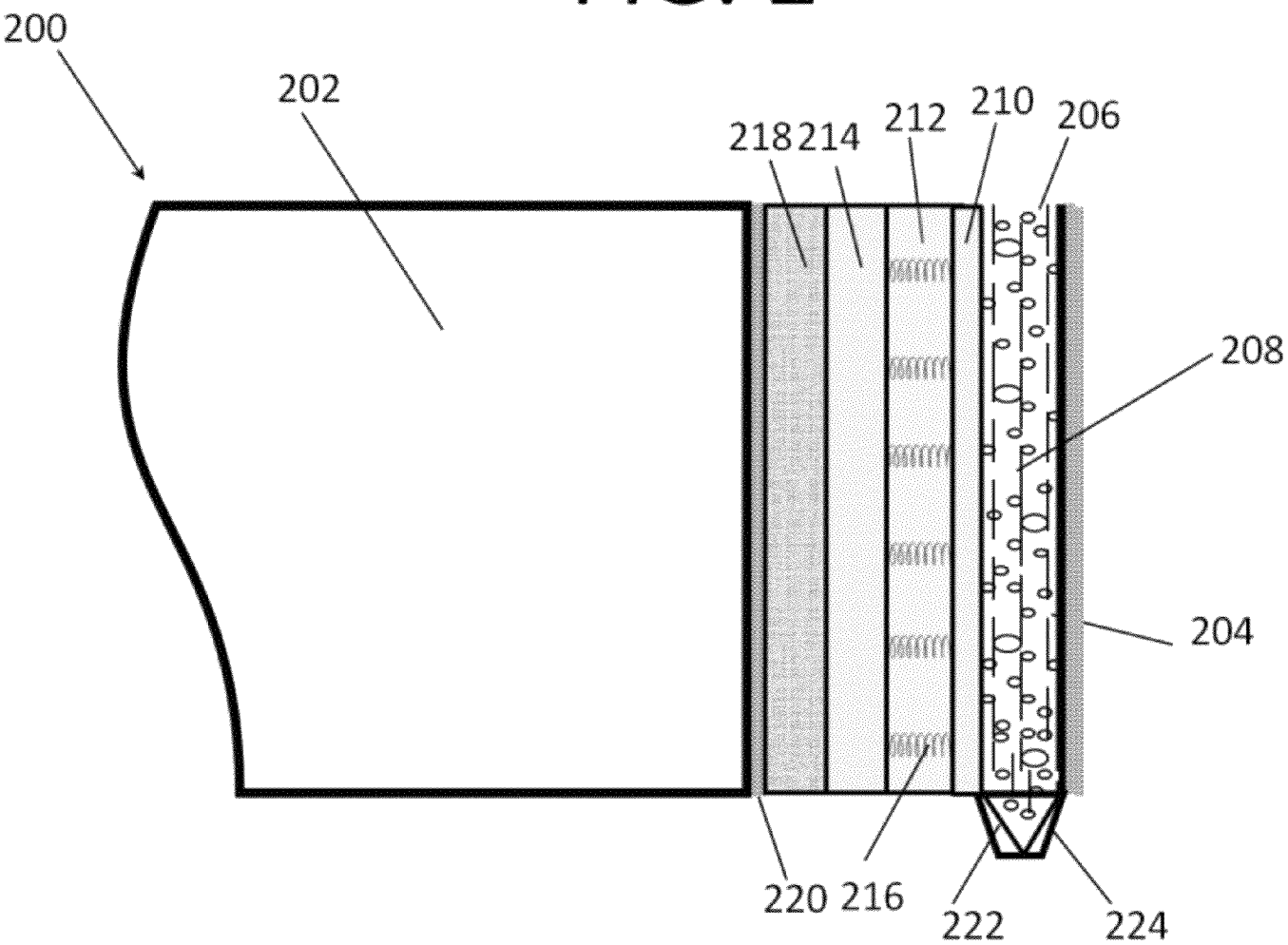
FIG. 2 illustrates a side view of a blast and ballistic protection system, according to an embodiment of the present invention.

FIG. 2 illustrates a side view of a blast and ballistic protection system 200, according to an embodiment of the present invention. In this embodiment, blast and ballistic protection system 200 is designed to protect a human body 202. System 200 has an outer layer of heat-resistant clothing material 204, a layer of tubes 206 filled with liquid 208, a lightweight metal alloy plate (the outer alloy plate) 210, a layer of packing foam 212, a lightweight metal alloy plate (the inner alloy plate) 214, springs 216 in packing foam 212 that are mounted between outer alloy plate 210 and inner alloy plate 214, a Kevlar® panel 218, and an inner layer of common clothing material 220. A tube valve 222 is installed at an end opening 224 of the layer of liquid-filled tubes 206.

Outer layer of heat resistant clothing material 202 may be made from any suitable fire-retardant material. U-shaped liquid-filled tubes 206 are installed vertically in semi-circular troughs, or grooves, of outer alloy plate 210, but the direction and shape are a matter of design choice. Liquid-filled tubes 206 act as a pressure transformer to convert the kinetic energy of a blast or ballistic pressure wave into hydraulic fluid pressure in liquid-filled tubes 206. The pressure is redirected via hydraulic fluid flow through the end of liquid-filled tubes 206, and then the liquid is released due to the hydraulic pressure via end opening 224. Liquid-filled tubes 206 and tube valve 222 may be made from a softer material, such as rubber, plastic (e.g., polyurethane, a polymer, polyvinyl chloride lining, etc.), canvas, etc. Liquid 208 can be water, ethanol, or any other suitable aqueous solution.

Outer alloy plate 210 and inner alloy plate 214 may be made of aluminium alloy, titanium alloy, or any other suitable strong but lightweight metal alloy material that not only provides effective protection against projectiles and fragments, but also works as a rigid framework that provides structure and support for the layer of liquid-filled tubes 206. However, if weight is not a factor and/or cost is an issue, heavier materials may be used. Springs 216 may be made from spring steel or any other suitable material. Springs 216 are elastic and store mechanical energy. Packing foam 212 may be made from expanded plastic materials such extruded high density polyethylene (XPS) and expandable polystyrene (EPS), which are able to resist the dynamic forces of a blast or ballistic pressure wave. Both springs 216 and packing foam layer 212 can help reduce blast or ballistic pressure on inner alloy plate 214, thus attenuating BABT resulting from the rapid deformation of armor covering the body. Kevlar® panel 218 is a bullet-resistant panel that is used for personal armor, such as ballistic vests, combat helmets, and ballistic face masks Inner layer of common clothing material 220 may be made from natural material (such as cloth, denim, down for down-filled parkas, fur, leather, etc.) or a synthetic fiber (such as nylon, polyester, spandex, etc.).

Figure 3:
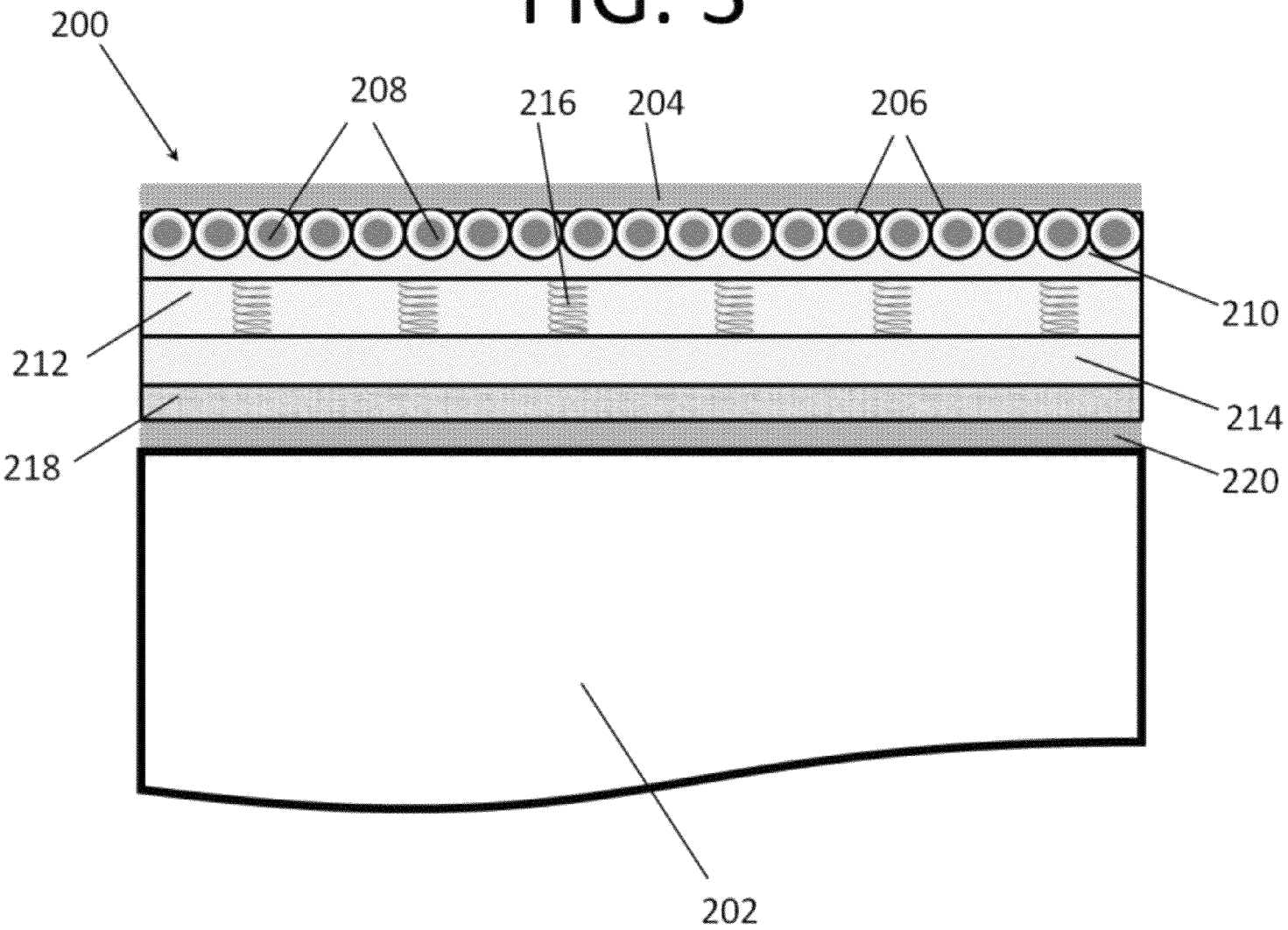
FIG. 3 illustrates a top view of the blast and ballistic protection system, according to an embodiment of the present invention.

FIG. 3 illustrates a top view of the blast and ballistic protection system 200, according to an embodiment of the present invention. In this view, the circular shape of liquid-filled tubes 206 and the grooves in outer alloy plate 210 are apparent.

Figure 4:
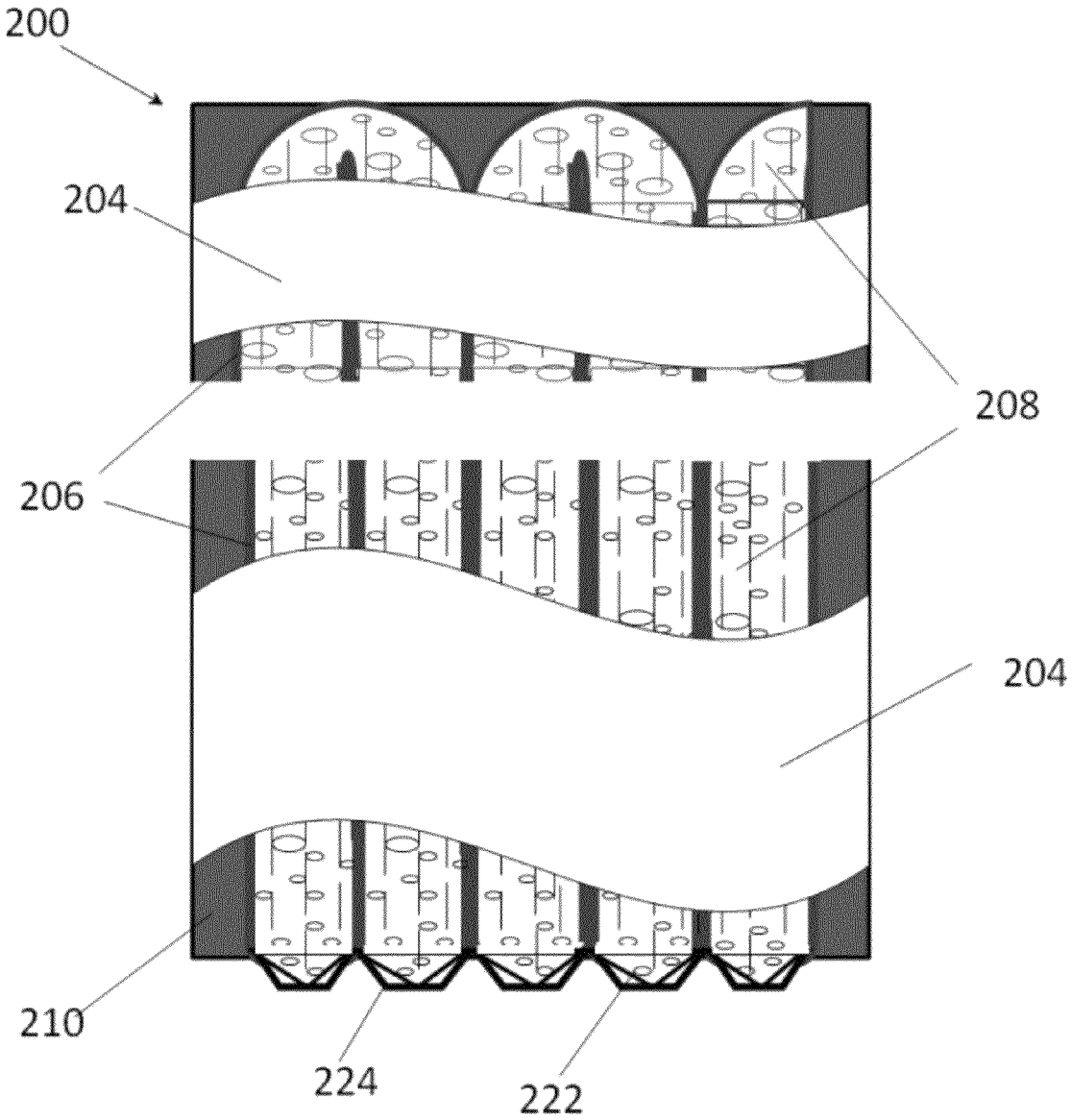
FIG. 4 illustrates a front view of the blast and ballistic protection system that shows the liquid-filled tubes, according to an embodiment of the present invention.

FIG. 4 illustrates a front view of the blast and ballistic protection system 200 that shows liquid-filled tubes 206, according to an embodiment of the present invention. As can be seen in the figure, liquid filled tubes 206 are U-shaped, and a pair of tube valves 222 are present for each tube. However, other shapes and configurations, such as only a single valve per tube, W-shaped tubes, or any other configuration and number of valves are possible in other embodiments.

Figure 5:
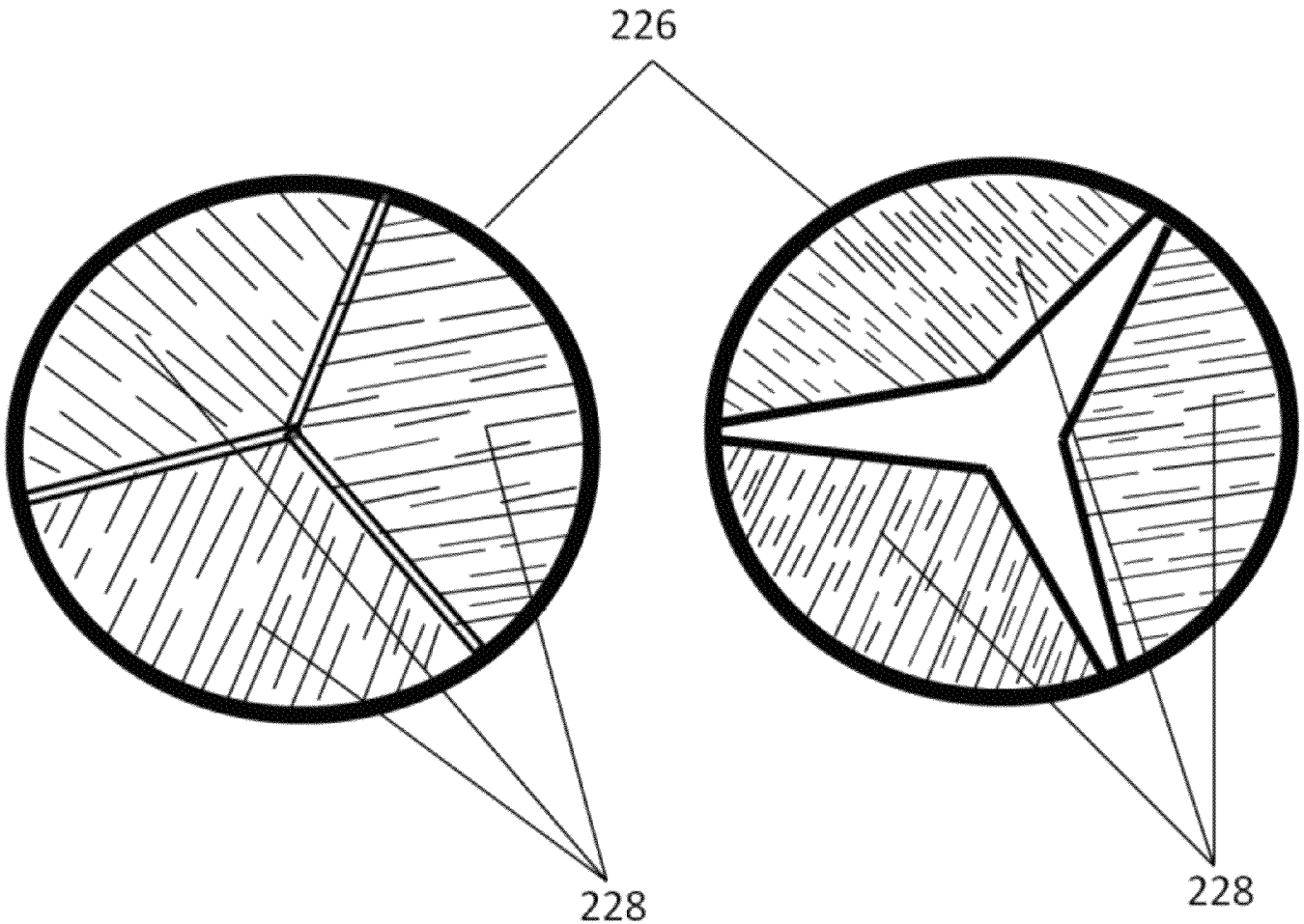
FIG. 5 illustrates a top view of an end opening of a liquid-filled tube of the blast and ballistic protection system, according to an embodiment of the present invention.

FIG. 5 illustrates a top view of an end opening 226 of a liquid-filled tube of blast and ballistic protection system 200, according to an embodiment of the present invention. This view shows flaps (of a valve) 228 of end opening 226 in both a closed state (left) and an open state (right). While there are three flaps in this embodiment, other embodiments may have a different number of flaps, or may use any other suitable valve mechanism to release fluid that is subjected to pressure.

Figure 6:
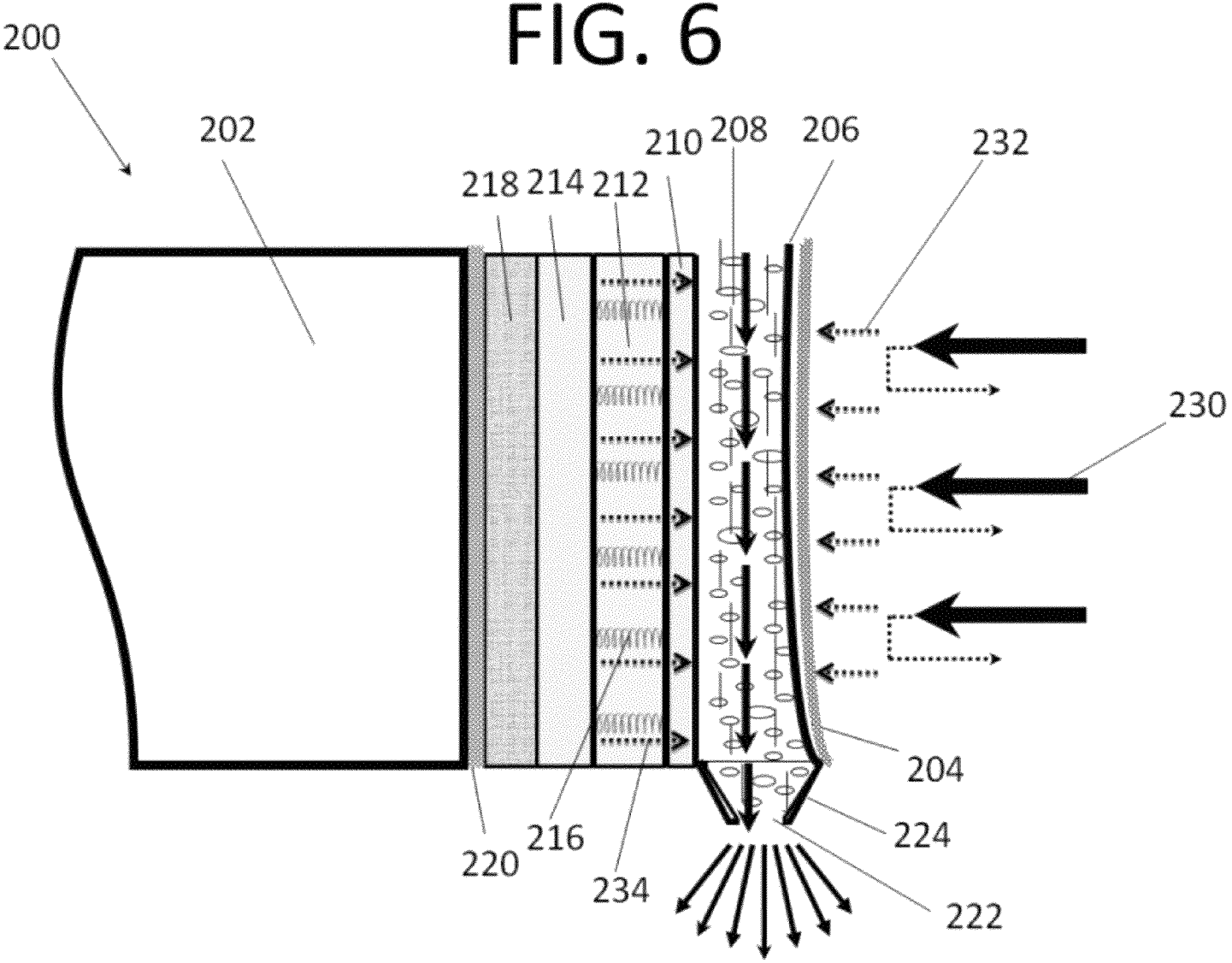
FIG. 6 illustrates a side view of the blast and ballistic protection system with blast energy redirection and release after a blast overpressure wave impacts the system, according to an embodiment of the present invention.

FIG. 6 illustrates a side view of blast and ballistic protection system 200 with blast energy redirection and release after a blast or ballistic pressure wave 230 impacts the system, according to an embodiment of the present invention. The rapid impact (compression) effects of blast or ballistic pressure wave 230 on system 200 create an action force 232 that compresses liquid-filled tubes 206 and presses the tubes against outer alloy plate 210, packing foam layer 212, springs 216, and inner alloy plate 214. While tubes are discussed here, any other liquid storage mechanism, such as a bag, bladder, fluid reservoir, etc. may be used in addition to, or in lieu of, the tubes in other embodiments, for both vehicle protection and personnel protection versions. Because outer alloy plate 210 and inner alloy plate 214 are rigid, the plates exert a reaction force 234 against liquid-filled tubes 206. Action force 232 and reaction force 234 push liquid 208 inside liquid-filled tubes 206 towards tube valve (or flaps) 224. Since liquid 208 is incompressible, increased liquid pressure on the end of liquid-filled tubes 206 forces tube valve (or flaps) 224 to open and make liquid 208 to spray out through end opening 222, thus rapidly decreasing the liquid pressure inside of liquid-filled tubes 206. The force required to open tube valve (or flaps) 224 is a matter of design choice, and any suitable valve or fluid release mechanism may be used. Further, the pressure threshold required to open the valve (or flaps) is a matter of design choice. Both springs 216 and packing foam layer 212 can help reduce the impact of action force 232 on inner alloy plate 214 and Kevlar® panel 218, thus mitigating BABT caused by the impact of action force 232.

Figure 7:
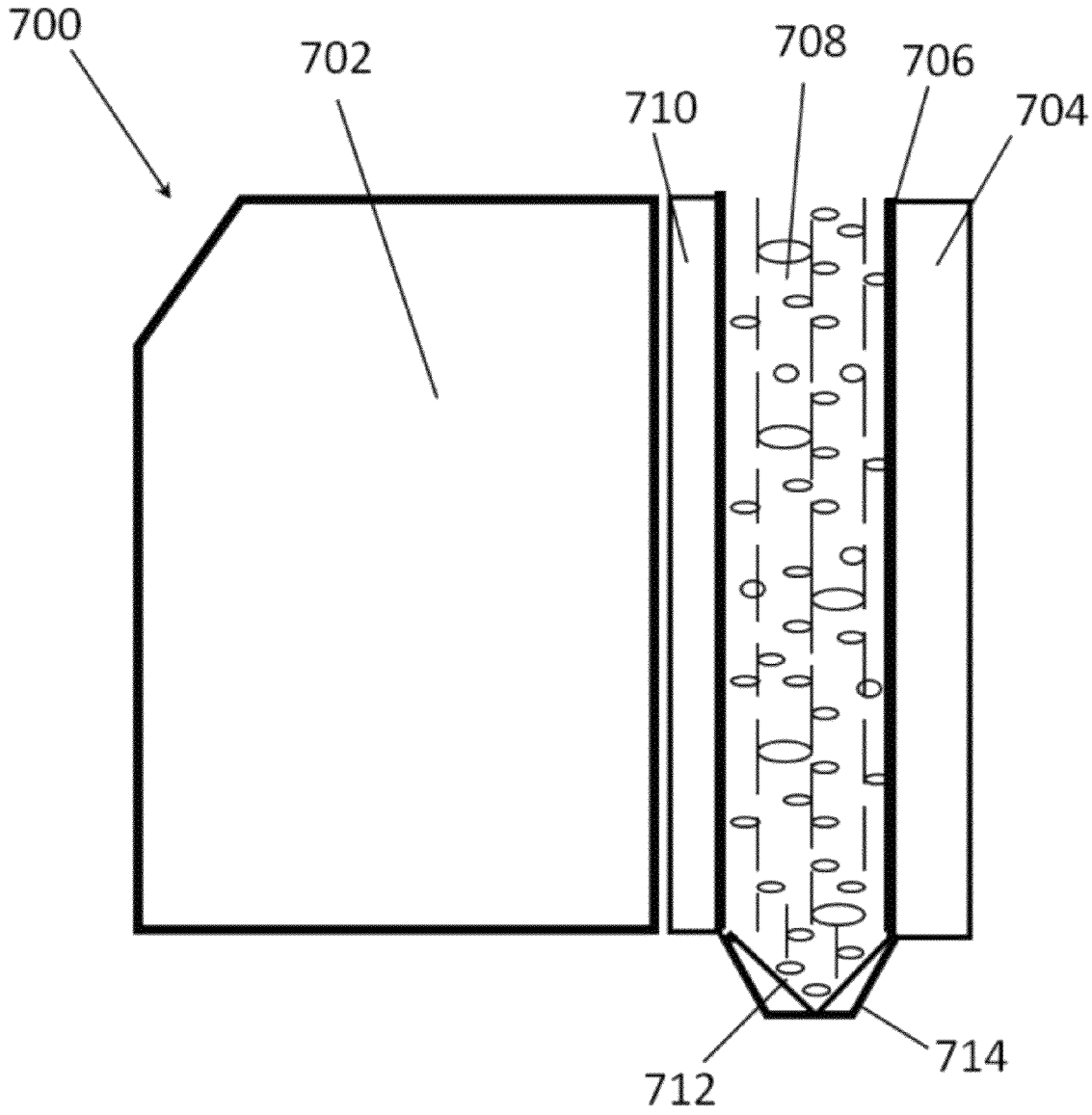
FIG. 7 illustrates a side view of a blast and ballistic protection system configured for military systems such as vehicles, according to an embodiment of the present invention.

FIG. 7 illustrates a side view of a blast and ballistic protection system 700 configured for military systems such as vehicles, according to an embodiment of the present invention. The system may be installed on the outside 702 of system 700. System 700 has an outer metal plate 704, a layer of liquid-filled pipes 706 filled with liquid 708, and an inner metal plate 710. A pipe valve 712 is installed at an end opening 714 of liquid-filled pipes 706.

Both outer metal plate 704 and inner metal plate 710 may be titanium alloy, stainless steel, or any other strong material. In some embodiments, the plates may not be metal, but rather carbon fiber composites, ceramics, or any other suitably strong material. U-shaped liquid-filled pipes 706 are installed vertically in semi-circular troughs or grooves of outer metal plate 704 and work as a pressure transformer to convert kinetic energy of a blast overpressure wave into hydraulic fluid pressure in liquid-filled pipes 706 in order to redirect the pressure via hydraulic fluid flow to the end of liquid-filled pipes 706, and then to release hydraulic pressure via end opening 714. Liquid-filled pipes 706 may be made from a softer material than outer and inner metal plates 704 and 710. Liquid 708 can be water or any other aqueous solution.

Figure 8:
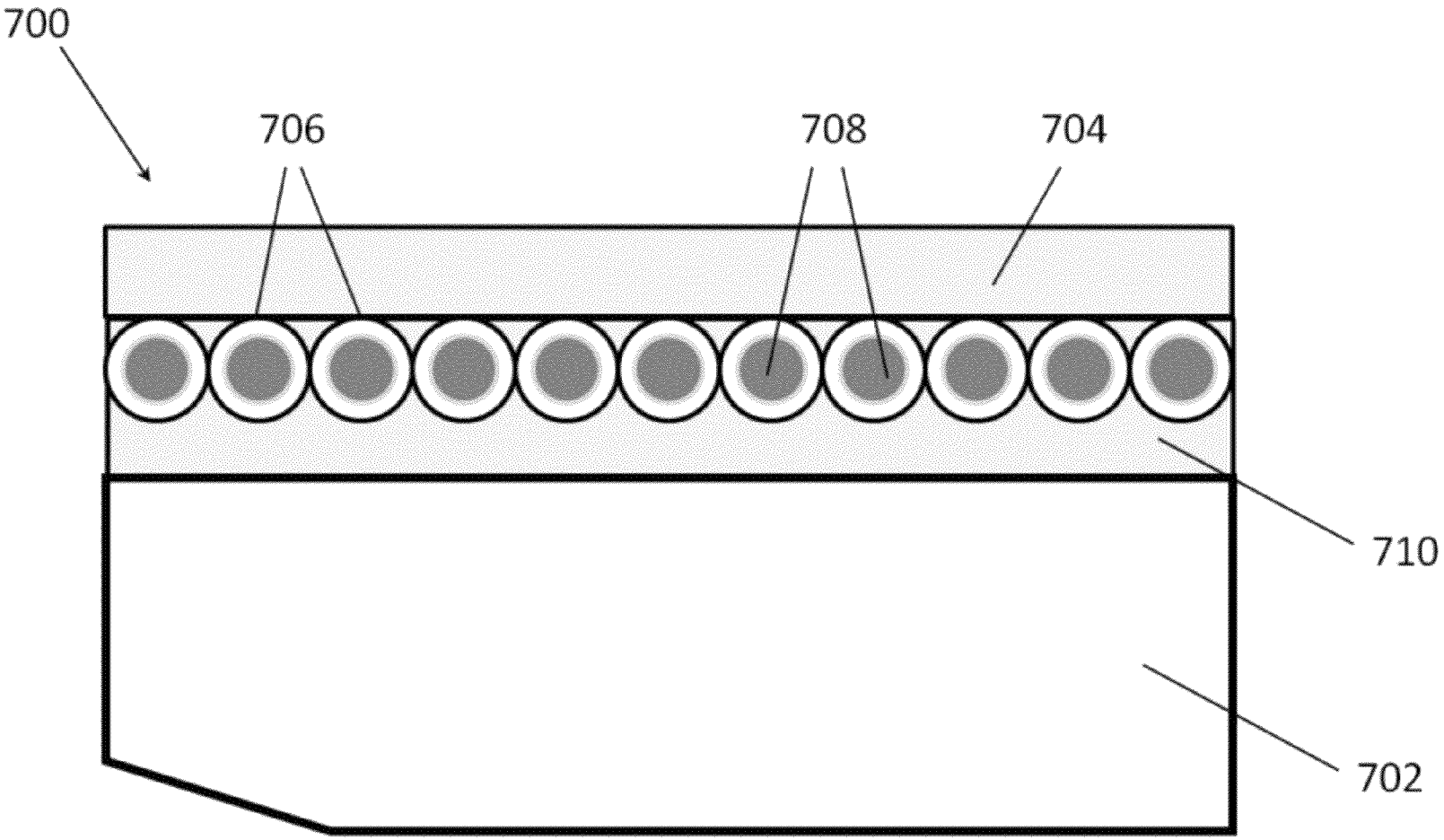
FIG. 8 illustrates a side view of the blast and ballistic protection system for military systems, according to an embodiment of the present invention.

FIG. 8 illustrates a side view of blast and ballistic protection system 700 for military weapon systems, according to an embodiment of the present invention. In this view, the circular shape of liquid-filled tubes 706 is apparent.

Figure 9:
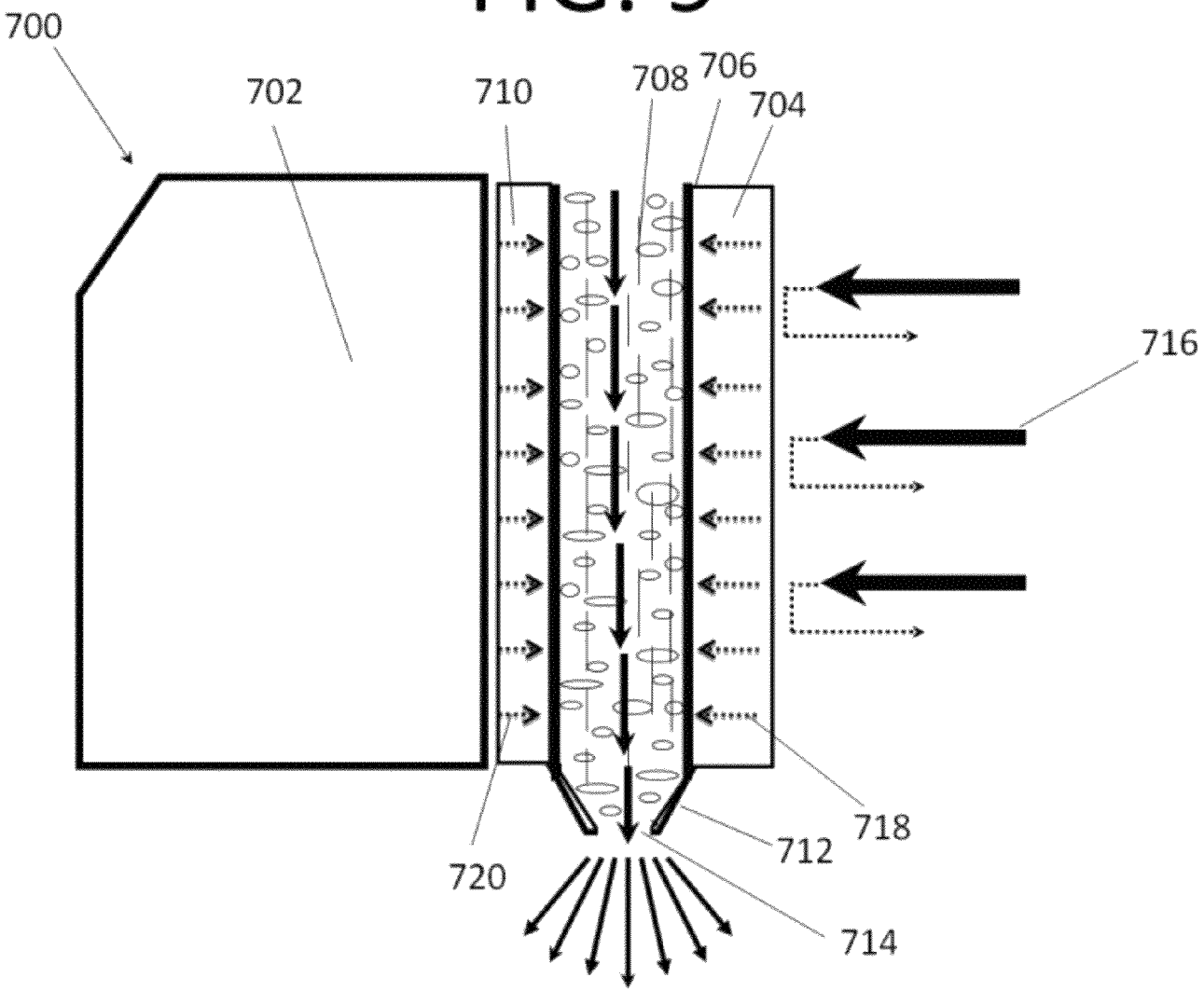
FIG. 9 illustrates a side view of the blast and ballistic protection system for military systems with blast energy redirection and release after a blast overpressure wave impacts the system, according to an embodiment of the present invention.

FIG. 9 illustrates a side view of blast and ballistic protection system 700 for military weapon systems with blast energy redirection and release after a blast overpressure wave 716 impacts system 700, according to an embodiment of the present invention. The rapid impact (compression) effects of blast or ballistic pressure wave 716 on outer metal plate 704 create an action force 718 that compresses liquid-filled pipes 706 and moves the pipes against inner metal plate 710. Inner metal plate 710 exerts a reaction force 720 against liquid-filled pipes 706. Action force 718 and reaction force 720 push liquid 708 inside liquid-filled pipes 706 flowing to the end of the pipes. Increased liquid pressure on the end of liquid-filled pipes 706 forces pipe valve (or flaps) 712 to open and allows liquid 708 to spray out through end opening 714, thus rapidly decreasing liquid pressure inside liquid-filled pipes 706.

Some embodiments of the present invention utilize fluid to transfer energy from a blast or impact from a ballistic projectile into kinetic energy. The fluid is allowed to move within the armor system in order to release the energy, such as via a valve mechanism. In this manner, overpressure from a blast or ballistic projectile is not directed towards the person or machine that is being protected by the armor system, but rather is redirected via the fluid away from the person or machine. In this manner, energy from blasts and projectile strikes may be largely transferred to the fluid and the survivability of the war fighter or machine having the armor system is increased. While liquids are discussed herein, it is understood that the definition of "liquid" also encompasses suspensions, gels, or any other substance capable of redirecting energy from a blast or projectile impact.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a liquid storage mechanism comprising a liquid;

an insulating layer internal to the liquid storage mechanism, wherein the insulating layer is positioned between an internal rigid layer and an external rigid layer, wherein the external rigid layer is configured to provide structure and support for the liquid storage mechanism; and a pressure release mechanism configured to transfer kinetic energy to the liquid, wherein when the liquid storage mechanism is impacted by a blast or ballistic pressure wave, the liquid storage mechanism is further configured to press against the external rigid layer, insulating layer and internal rigid layer, and the liquid storage mechanism is configured to release the liquid via the pressure release mechanism when a blast or ballistic pressure wave opens or otherwise activates the pressure release mechanism.

2. The apparatus of claim 1, further comprising:

a woven fabric layer configured to resist penetration by projectiles.

3. The apparatus of claim 1, wherein the insulating layer comprises a series of springs and packing foam configured to absorb blast or ballistic energy and redirect the energy towards the liquid storage mechanism.

4. The apparatus of claim 1, wherein the internal and external rigid layers comprise one or more of a metal alloy, a carbon fiber composite material, and a ceramic material.

5. The apparatus of claim 1, wherein the liquid storage mechanism comprises a series of U-shaped tubes and the pressure release mechanism comprises one or more valves or flaps.

6. The apparatus of claim 1, wherein the liquid storage mechanism comprises a series of tubes and the external rigid layer comprises a series of grooves formed to fit and house the liquid storage mechanism.

7. The apparatus of claim 1, wherein the apparatus is part of an article worn by a human.

8. The apparatus of claim 1, wherein the apparatus is secured to an external surface of a military land, sea, or air vehicle.

* * * * *